US005562051A

United States Patent [19]

Rizzi

[11] Patent Number: 5,562,051

[45] Date of Patent: Oct. 8, 1996

[54] FOLDING TABLE LEG CONSTRUCTION

[75] Inventor: John J. Rizzi, Weston, Conn.

[73] Assignee: Steelcase, Inc., Grand Rapids, Mich.

[21] Appl. No.: 249,391

[22] Filed: May 26, 1994

[51] Int. Cl.[6] ..... A47B 3/00

[52] U.S. Cl. ..... 108/132; 248/439

[58] Field of Search ..... 108/132, 133, 108/131, 130, 129; 248/188.6, 188.1, 439

[56] References Cited

U.S. PATENT DOCUMENTS

| | | | |
|---|---|---|---|
| 441,569 | 11/1890 | Ladd . | |
| 2,075,778 | 3/1937 | Johannsen . | |
| 2,318,945 | 5/1943 | Johannsen . | |
| 2,657,963 | 11/1953 | Fox . | |
| 2,666,683 | 1/1954 | Pucci . | |
| 2,695,827 | 11/1954 | De Saussure, Jr. . | |
| 2,860,940 | 11/1958 | De Saussure | 108/133 |
| 3,349,728 | 10/1967 | Barecki et al. . | |
| 3,769,920 | 11/1973 | Weiss | 108/133 |
| 4,444,124 | 4/1984 | Burr | 108/132 X |
| 4,658,735 | 4/1987 | Holton | 108/132 X |
| 4,827,851 | 5/1989 | Diffrient . | |
| 4,838,180 | 6/1989 | Gutgsell | 108/132 |

FOREIGN PATENT DOCUMENTS

| | | | |
|---|---|---|---|
| 267344 | 3/1950 | Switzerland | 108/133 |
| 8001508 | 6/1980 | WIPO | 248/188.6 |

*Primary Examiner*—José V. Chen

*Attorney, Agent, or Firm*—Price, Heneveld, Cooper, DeWitt & Litton

[57] ABSTRACT

A table includes a tabletop and a pair of opposing folding leg assemblies. Each folding leg assembly includes a base plate secured to the tabletop. A folding leg is pivotally connected to the base plate by a linkage arrangement that includes first links pivotally connecting the folding leg to the base to define first and second axes of rotation and a U-shaped second link pivotally connecting the folding leg to the base to define third and fourth axes of rotation. The second link further includes a transverse section, and a latch is secured to the base plate for releasably engaging the transverse section when the folding leg is in the extended position. The first, second, third, and fourth axes are spaced from each other and located so that the folding legs fold flat against the tabletop when in the folded position, but so that the axes do not move "on center" or "over center" and cause the legs to lock up when in the folded position.

17 Claims, 5 Drawing Sheets

FOLDING TABLE LEG CONSTRUCTION

BACKGROUND OF THE INVENTION

The present invention relates to tables, and in particular to a table including folding legs movable between a secure extended position for use and a compact folded position to facilitate storage.

Tables are often provided with folding legs that move between an extended position and a folded position to facilitate set-up, tear-down, shipment and storage. A latching mechanism is usually provided on the folding legs to hold the legs in the extended position so that they do not accidentally unexpectedly collapse during use. However, many latching mechanisms are unsightly and less than attractive. Also, the latching mechanisms can be difficult and/or awkward to operate, or do not retain the legs in the extended position as securely as desired. Aside from the problems of latching mechanisms, it is desirable to fold the legs flat against the tabletop to provide a minimum thickness to facilitate storage. This is a problem where a pair of opposing folding legs on a table each include a transverse member near the bottom of the legs and the legs are so long that they overlap at the bottom when in the folded position. The overlapping legs not only damage and scratch each other, but also the legs are prevented from laying flat against the tabletop, thus requiring additional storage space. As a result, in many known tables having folding legs, the folded position of the legs at least partially dictates the style and design of the legs.

Thus, an improved table including latchable folding legs solving the aforementioned problems is desired. Also, a hinge arrangement is desired which is easily assembled to a tabletop, which maximizes efficient use of the space under the tabletop, and which also facilitates movement of the legs into and out of the folded position.

SUMMARY OF THE INVENTION

One aspect of the present invention includes a table having a tabletop, and a folding leg movably connected to the tabletop by a linkage arrangement for movement between an extended position for supporting the tabletop and a folded position for storage. The linkage arrangement includes a U-shaped link, and a releasable center latch is provided for releasably engaging the U-shaped link to stabilize the folding leg when in the folded position. In the preferred embodiment, the linkage arrangement forms a four-bar linkage defining four axes of rotation, and at least one of the axes of rotation is offset from a plane connecting the two axes fixed relative to the tabletop so that the links do not tend to lock up in an "on center" or "over center" relationship when in the folded position. Thus, the folding leg can be readily moved from the folded position.

These and other features and advantages of the present invention will be further understood and appreciated by those skilled in the art by reference to the following specification, claims and appended drawings.

DETAILED DESCRIPTION OF PREFERRED EMBODIMENT

Figure 2:
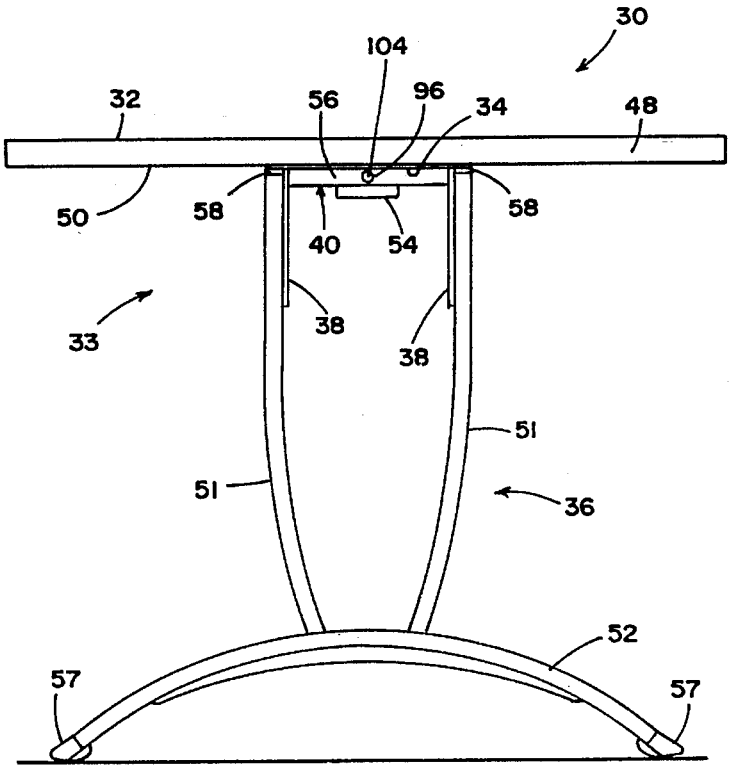
FIG. 2 is an end view of the table shown in FIG. 1.

For purposes of description herein, the terms "upper," "lower," "right," "left," "rear," "front," "vertical," "horizontal" and derivatives thereof shall relate to the invention as oriented in FIG. 2, the front of the table being toward the left of the page. However, it is to be understood that the invention may assume various alterative orientations, except where expressly specified to the contrary. It is also to be understood that the specific drawings and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
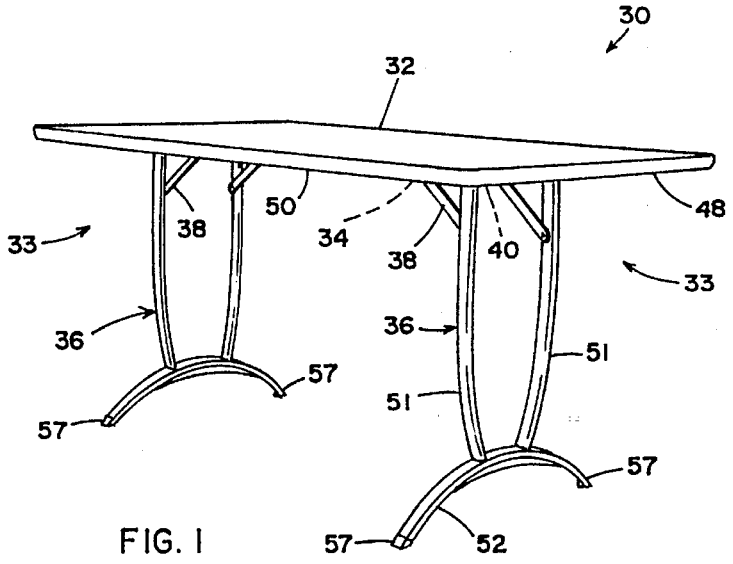
FIG. 1 is a perspective view of a table including folding legs embodying the present invention.
Figure 3:
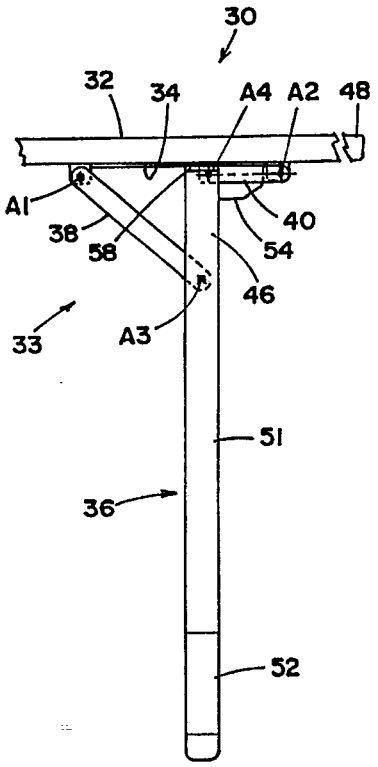
FIG. 3 is a fragmentary side view of the table shown in FIG. 1.
Figure 4:
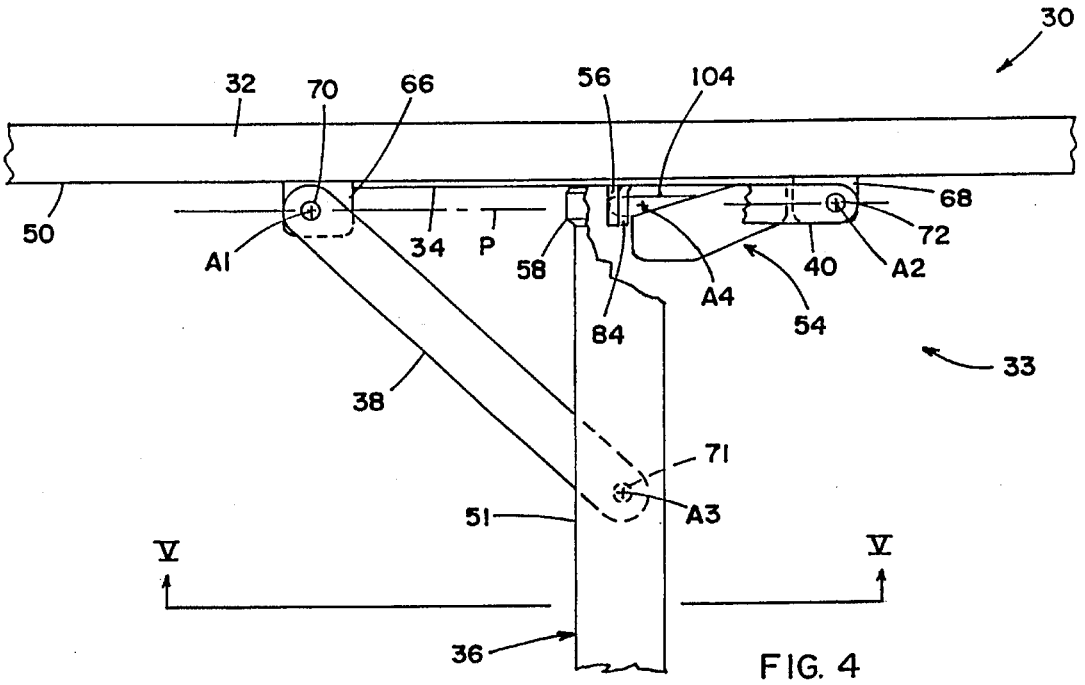
FIG. 4 is an enlarged fragmentary side view of the folding leg and the linkage arrangement shown in FIG. 3, the folding leg being latched in the extended use position.
Figure 16:
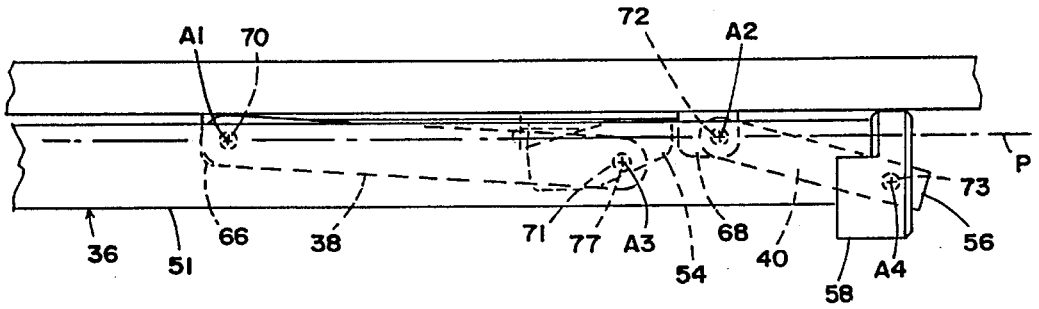
FIGS. 16–19 are side views showing a leg being moved from a folded position (FIG. 16) to an extended and nearly latched position (FIG. 19).

A table 30 (FIG. 1) embodying the present invention includes a tabletop 32 and a pair of folding leg assemblies 33 secured to the bottom surface of tabletop 32. Leg assemblies 33 (FIG. 2) each include a leg supporting base plate 34, and a folding leg 36 movably connected to base plate 34 by a "four bar" linkage arrangement including links 38 and 40. Links 38 and 40 are pivotally connected to base plate 34 and to leg 36 at separated axes A1–A4 (FIG. 3) such that the upper portion 46 of leg 36 swings toward an edge 48 of tabletop 32 as leg 36 is moved from an extended position (see FIGS. 1–4) to a folded position (FIG. 16). This movement improves the utilization of space under the table 30, so that inverted Y-shaped collapsible legs 36 having a transverse floor engaging member 52 at their lower end can be used without transverse member 52 overlapping onto an adjacent leg 36. A latch 54 (FIG. 5) is attached to base plate 34, and link 40 includes a transverse section 56 that frictionally engages latch 54 when in the extended position to increase the stability of legs 36 when table 30 is in use. Axes A1–A4 (FIG. 16) are offset from each other so that they cannot be moved to an "over center" or "on center" position when legs 36 are in the folded position. This prevents a lock up condition and thus facilitates moving the legs 36 from the folded position to the extended position.

Tabletop 32 (FIG. 1) is generally planar and rectangular, although different shapes and sizes can be used. Tabletop 32 includes an edge 48 extending around the perimeter of tabletop 32, and a bottom surface 50.

Folding legs 36 (FIGS. 2–3) have an inverted Y-shaped construction and include a pair of beam-like weight bearing tubular members 51 interconnected at the bottom by transverse arcuately-shaped floor-engaging member 52. Weight bearing members 51 have an elliptical tubular cross section which provides aesthetics and also adds strength to leg 36. The lateral spacing of tubular members 51 and the span of transverse floor engaging member 52 also add stability to the overall structure. Transverse member 52 rigidly interconnects weight bearing members 51, and it is contemplated that additional transverse members can be added to further rigidify leg 36 if desired. A pair of caps 57 made of a molded material are secured to the ends of transverse floor engaging member 52 to prevent damage to the floor/support surface that supports table 30. Also, caps 58 (FIGS. 4–5) are secured to the upper end of tubular members 51 for engaging base plate ears 74A. Cap 58 prevents undesirable wear and/or noise as tabletop 32 shifts relative to legs 36 during use. Legs 36 have an inverted Y-shaped construction for aesthetics and optimal stability, however the present invention is contemplated to include alterative leg constructions. It is noted that the present hinge arrangement is particularly suited for securing legs which cannot overlappingly mateably fold into each other as the legs are moved to the folded position adjacent bottom surface 50 of tabletop 32.

Figure 7:
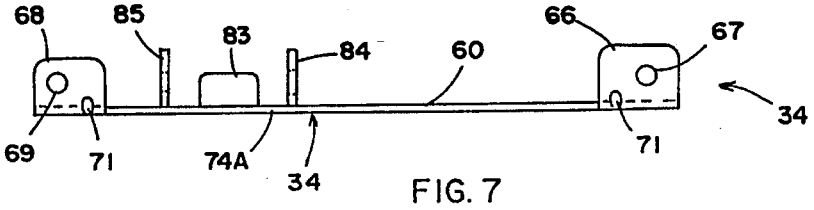
FIG. 7 is a side view of the base plate shown in FIG. 6.

Base plate or bracket 34 (FIG. 7) includes a planar tabletop-engaging section 60 for stably engaging the bottom surface 50 (FIG. 5) of tabletop 32. Holes 62 are provided in planar section 60 for receiving screws 64 to secure base plate 34 to tabletop 32, although it is noted that other fastening mechanisms can be used. The dimensions of planar section 60 are chosen based on the width of tubular members 51 in legs 36, the functional requirements of table 30 and the strength of the material comprising tabletop 32 and legs 36. Pivot forming flanges 66 and 68 (FIG. 7) are located at the corners of planar section 60 and extend perpendicularly downwardly from tabletop 32. Gussets 71 are formed at the juncture of planar section 60 and flanges 66 and 68 to strengthen and stabilize flanges 66 and 68. Holes 67 and 69 are located in flanges 66 and 68, respectively, for receiving pivot pins 70 and 72 (FIG. 5) to pivotally connect links 38 and 40 to base plate 34. Holes 67 and 69 define the first and second axes of rotation "A1" and "A2" for links 38 and 40, as discussed below. Planar section 60 includes ears 74A that engage the two caps 58 at the upper ends of tubular members 51 when leg 36 is in the extended position. Cutouts 78, 79 and 80 are located around the perimeter of planar section 60 as desired to reduce weight. Also, the cutouts 78, 79 and 80 provide a distinctive attractive appearance.

Four integral tabs 82–85 (FIGS. 6–9) are formed from the material in the center of planar section 60. Tabs 82–85 form a rectangular pattern for holding latch 54. Tabs 82 and 83 are located in opposing spaced apart relationship between the edges of tabs 84 and 85. Tab 84 includes a square hole 86 and tab 85 includes a round hole 87 which cooperate with latch 54, as described below.

Figure 5:
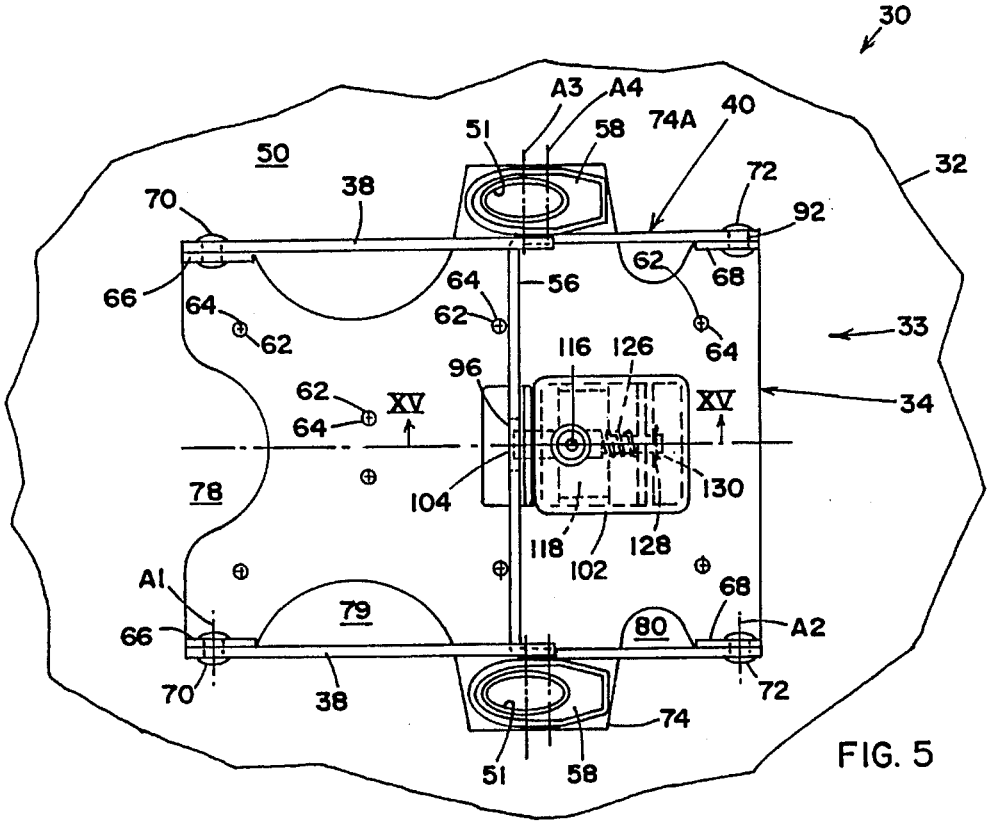
FIG. 5 is a fragmentary bottom cross-sectional view of the folding leg and the hinge arrangement shown in FIG. 4.
Figure 6:
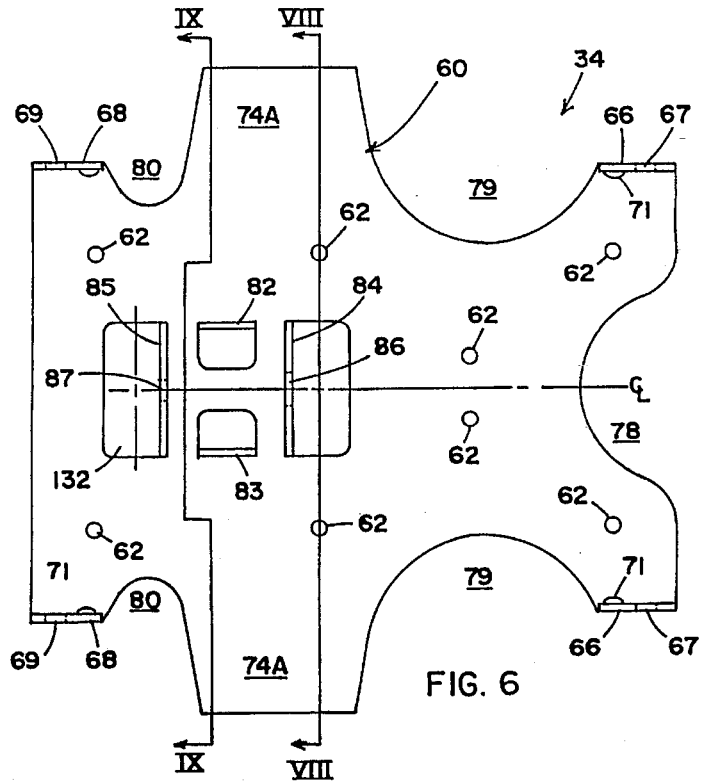
FIG. 6 an enlarged plan view of the leg supporting base plate shown in FIG. 5.
Figure 8:
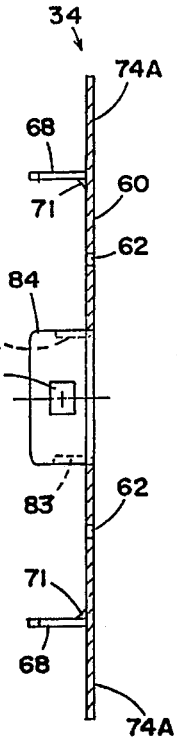
FIGS. 8–9 are cross-sectional views taken along the planes VIII—VIII and IX—IX in FIG. 6.
Figure 9:
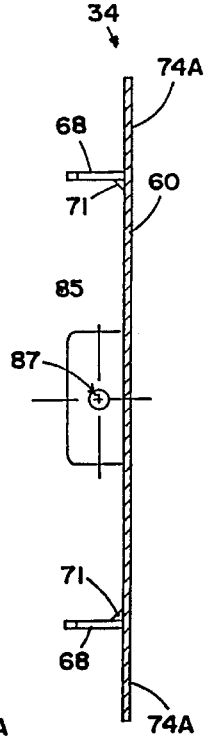
Figure 10:
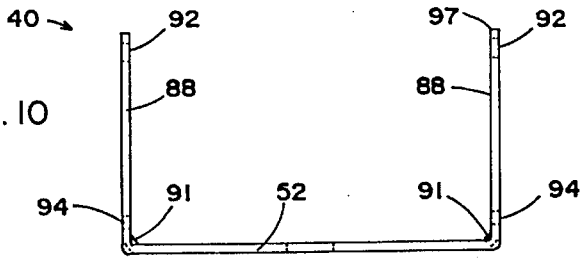
FIGS. 10–12 are orthogonal views of the U-shaped link shown in FIG. 5.
Figure 11:
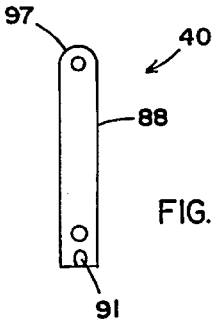
Figure 12:
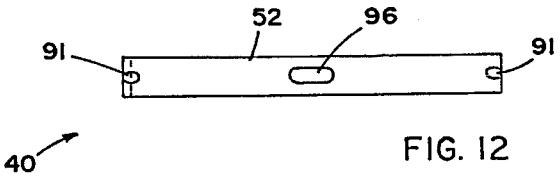
Figure 18:
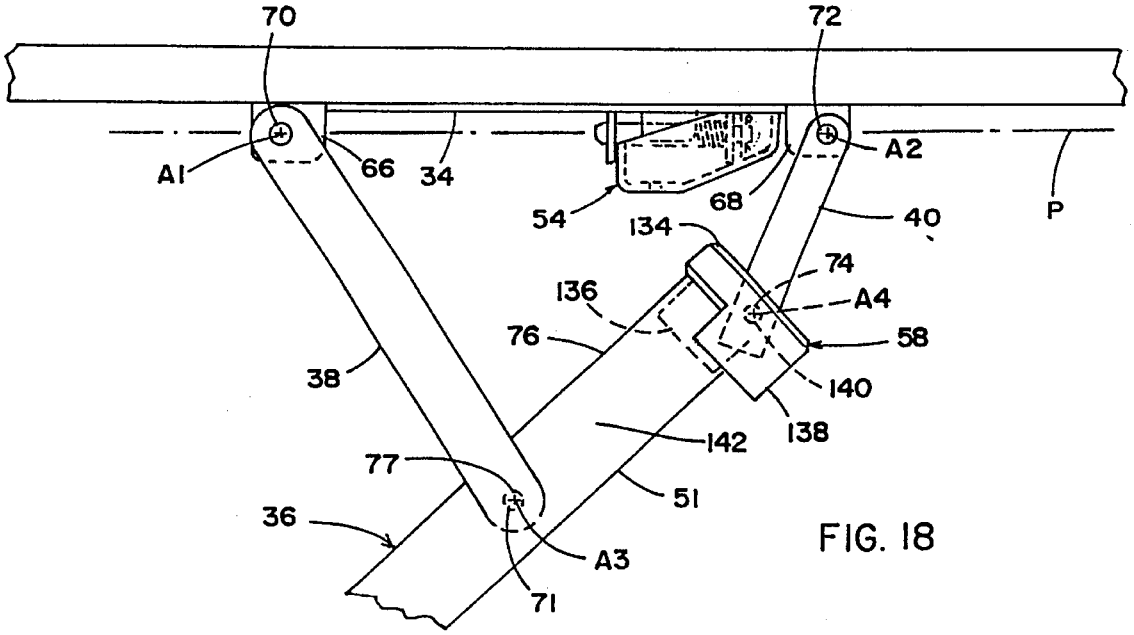

There are two links 38 and one link 40 in each folding leg assembly 33 (FIG. 5). Links 38 are planar and include holes at each end and are pivotally attached to base plate flange 66 by pivot pin 70 and to table leg 36 by pivot pin 71. Pivot pin 71 defines the third axis of rotation "A3". Link 40 (FIGS. 10–12) is U-shaped and includes side sections 88 interconnected by the transverse section 56. Gussets 91 are formed on the corners connecting sections 88 and 56 to stabilize the sections relative to each other. Side sections 88 include pivot forming holes 92 and 94. Pivot pin 72 pivotally engages pivot forming holes 92 to connect link 40 to the pivot forming flanges 68 on base plate 34 and pivot pin 74 (FIG. 18) pivotally engages pivot forming holes (94) on link 40 and securely engages cap 58 on leg 36 to pivotally connect link 40 to leg 36. Pivot pin 74 defines the fourth axis of rotation "A4". A square hole 96 is formed in transverse section 56 for frictional engagement by the tapered end of latch 54. The free ends 97 (FIG. 11) of side sections 88 are rounded to facilitate the pivoting motion of link 40 as leg 36 is moved between the folded position and the extended position.

Figure 13:
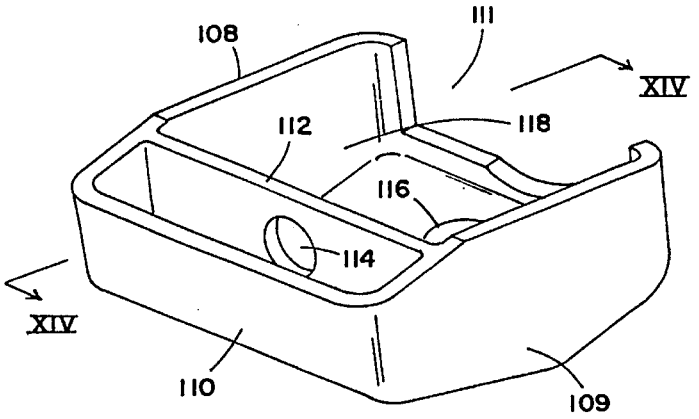
FIG. 13 is perspective view of the latch housing shown in FIG. 5.
Figure 14:
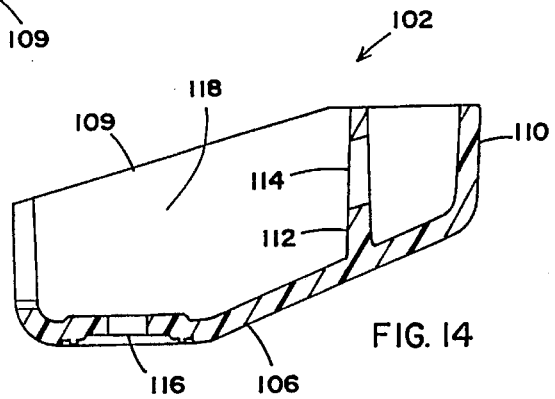
FIG. 14 is a cross-sectional view taken along the plane XIV—XIV in FIG. 13.

Latch 54 (FIG. 15) includes a cup-shaped housing 102 and a latching member 104 slideably positioned in housing 102. Housing 102 (FIGS. 13–14) includes a bottom cover section 106, sidewalls 108 and 109, and an end wall 110 defining a pocket 118. An open end 111 is defined between sidewalls 108 and 109 at one end of housing 102 opposite end wall 110. An intermediate wall 112 extends between sidewalls 108 and 109. A hole 114 is located in intermediate wall 112 for slideably receiving the shaft of latching member 104. An access hole 116 in the bottom cover section 106 allows access to the pocket 118 defined within housing 102, such as for accessing latch member 104 after assembly. Notably, it is contemplated that access hole 116 could be enlarged or expanded into a slot, and a handle (not shown) could be attached to latching member 104 and extended through the slot so that an operator could manually move latching member 104 to a retracted release position against the bias of latch-biasing spring 126, discussed below.

When housing 102 (FIG. 15) is assembled to base plate 34, housing sidewalls 108 and 109 engage the outside surfaces of flanges 82 (and 83) to securely hold latch 54 in a centered position on base plate 34. Also, end wall 110 and intermediate wall 112 are located between and adjacent flanges 84 and 85, respectively. Latching member 104 includes a round shaft section 120 that fits slideably mateably into hole 114 in intermediate wall 112 and further fits slideably mateably into round hole 87 in tab 85. Latching member 104 further includes a square shaft section 122 that mateably engages square hole 86 in tab 84. A shoulder 124 is formed at the juncture of shaft sections 120 and 122. A coil spring 126 positioned on round shaft section 122 is compressed between tab 85 and shoulder 124. Spring 126 biases latching member 104 toward engagement with transverse member 56. The free end of round shaft section 120 is configured to receive a washer 128 and cotter pin 130 to securely hold latching member 104 on intermediate wall 112. Notably, washer 128 and cotter pin 130 are assembled through the aperture 132 (FIG. 6) in base plate 34 adjacent tab 85.

The caps 58 (FIG. 18) on the upper end of leg weight bearing members 51 include an end forming section of material 134 for abuttingly engaging ears (74) on the bottom of tabletop 32. Inner and outer tube engaging sections 136 and 138 extend from end forming section 134, and define a groove therebetween for mateably receiving the end of tubular weight bearing member 51. Caps 58 are press-fit onto weight bearing members 51 and frictionally retained thereon, although it is within the present invention to also include other retention means such as fasteners or adhesives.

Pivot forming holes 140 (FIG. 18) are located in end forming section 134 in a position offset from the longitudinal center line 142 defined by weight bearing members 51. When leg 36 is in the folded position (FIG. 16), holes 140

Figure 17:
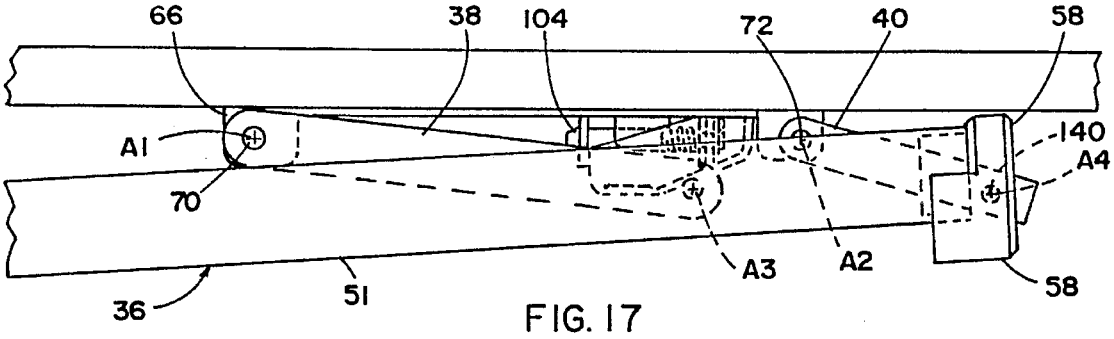
Figure 19:
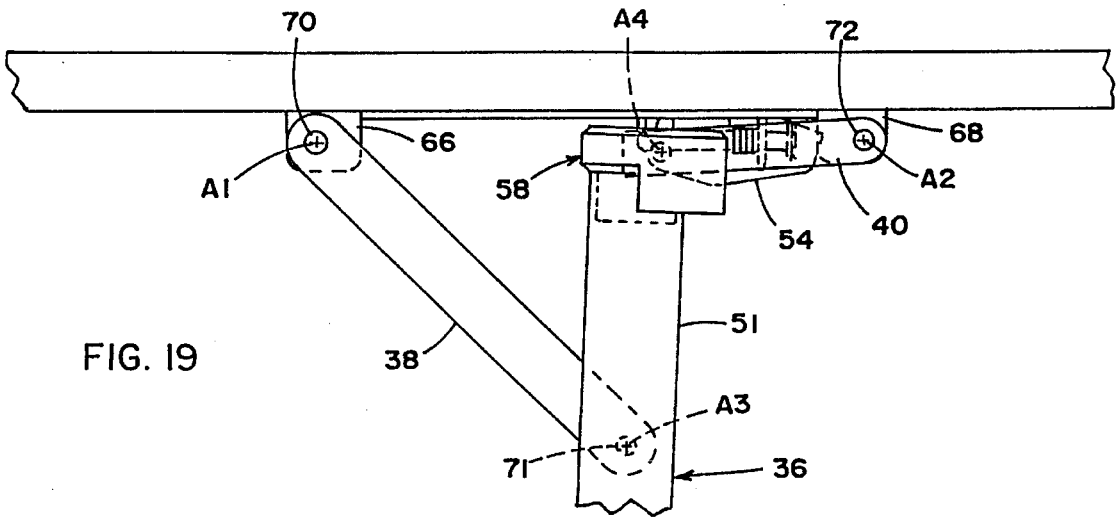

(i.e. axis "A4") are located a greater distance from tabletop bottom surface 50 than pivot holes 67 and 69 (i.e. axes "A1" and "A2") in pivot forming flanges 66 and 68. In particular, holes 140 are located below a plane "P" defined by axes "A1" and "A2". Also, holes 77 (i.e. axis "A3") in the upper ends 76 of leg 36 are also located below plane "P" when leg 36 is in the folded position. This avoids an "on center" or "over center" condition in which leg 36 is locked in the folded position by links 38 and 40. In particular, as leg 36 is moved from the folded position (FIG. 16) through the intermediate positions (FIGS. 17–19) to the extended latched use position (FIG. 4), the pivot points of link 40 (FIG. 16) are oriented at an angle so that link 40 does not lock up and bind and prevent leg 36 from being easily moved out of the folded position. As leg 36 reaches the extended position (FIGS. 4 and 15), latching member 104 engages hole 96 in transverse section 52 of link 40 and axis "A4" is located "on center" on the plane P defined by axes "A1" and "A2" to stabilize leg 36. The spring 126 biases latching member 104 into frictional engagement with link 40, but permits leg 36 including link 40 to be conveniently moved from the extended position to the folded position. Notably, leg 36 is shifted laterally toward an end of table 30 by links 38 and 40 as leg 36 is folded, thus making greater/more efficient use of the room under tabletop 32 for storage of legs 36.

Accordingly, a table is provided including folding leg assemblies having a "four bar" linkage arrangement are movable to a securely latched extended position at which a latch securely engages a transverse member on one of the links. Also, the linkage arrangement moves the legs with an offset motion to maximize use of space under the tabletop and so that the legs can be folded flat against the bottom surface of the tabletop. Thus, legs including a transverse floor engaging member interconnecting elongated weight bearing members can be folded flat against the underside of the tabletop even when the legs would normally be expected to strike each other if folded without the offset motion. Further, the legs are pivotally connected to the tabletop by a linkage arrangement which cooperates with a latch to provide a secure latched extended position and a flat folded position of the legs adjacent the tabletop bottom surface. Still further, the last movement of the leg into the extended position is perpendicular to the tabletop, thus creating a stable folded position wherein the leg is not likely to be accidentally bumped out of the extended position.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A table comprising:

a tabletop;

a folding leg movable between an extended position for supporting said tabletop and a folded position for storage;

a base plate secured to an underside of said tabletop, said base plate including leg-supporting side flanges and spaced apart latch-supporting flanges oriented perpendicularly to said leg-supporting side flanges;

a four-bar linkage arrangement pivotally secured to the leg supporting side flanges of said base plate and to said folding leg for movably connecting said folding leg to said tabletop, said linkage arrangement including a U-shaped link defining a transverse section; and a single, axially extensible releasable center latch operably mounted to said latch-supporting flanges of said base plate for releasably engaging the transverse section of said U-shaped link to stabilize the table when said folding leg is in said extended position, said transverse section being positioned proximate and frictionally engaged by said latch when said folding leg is in said extended position.

2. A table as defined in claim 1 wherein said U-shaped link includes a pair of spaced side sections connected to said transverse section, and said folding leg includes a pair of weight bearing members each pivotally connected to an exterior side of said side sections.

3. A table as defined in claim 2 wherein said folding leg includes a floor engaging member that is connected to and extends between said weight bearing members of said folding leg.

4. A table as defined in claim 3 including a pair of said linkage arrangements secured to said tabletop in opposing relationship.

5. A table as defined in claim 2 wherein said linkage arrangement includes straight links each connected to an interior side of said pair of weight bearing members, said straight links and said side sections of said U-shaped link forming a four-bar linkage with said tabletop and said foldable leg.

6. A table as defined in claim 1 wherein said linkage arrangement includes second links, said second links and the sides of said U-shaped link forming a four-bar linkage connecting said folding leg to said tabletop.

7. A table as defined in claim 6 wherein said tabletop and said folding leg define first, second, third and fourth axes of rotation, said first and second axes being fixed relative to said tabletop, said third and fourth axes being fixed relative to said folding leg, said third axis being offset from a plane connecting said first and second axes when said folding leg is in said folded position to facilitate unfolding said folding leg.

8. A table as defined in claim 7 wherein both of said third and fourth axes are located on the same side of said plane from said tabletop when said folding leg is in said folded position.

9. A table as defined in claim 1 wherein said latch-supporting flanges are oriented perpendicularly to said leg-supporting flanges.

10. A table as defined in claim 9 wherein said latch includes a concavely-shaped housing operably supported on the base plate for cooperating with and for aesthetically covering the latching member.

11. A table as defined in claim 10 wherein the concavely-shaped housing includes a transverse flange positioned adjacent one of the latch-supporting flanges.

12. A table as defined in claim 11 wherein said transverse flange and said one latch-supporting flange each include a hole for slidably supporting said latching member.

13. A table comprising:

a tabletop; and at least one folding leg assembly including:

a bracket secured to said tabletop, said bracket including leg-supporting flanges and bracket-engaging pivots engaging the leg-supporting flanges defining first and second axes of rotation, respectively, and further including transverse latch-supporting flanges;

a folding leg movable between an extended position and a folded position, said folding leg including leg-engaging pivots defining third and fourth axes of rotation;

a linkage arrangement including first links pivotally connecting said folding leg to said bracket at said first and third axes and a second link including side members pivotally connecting said folding leg to said bracket at said second and fourth axes, said second link further including a transverse section extending between said side members; and a latch secured to said bracket along a centerline defined by the bracket for releasably engaging said transverse section when said folding leg is in said extended position, said latch including a spring-biased latching member axially slidably supported on said latch-supporting flanges and a cup-shaped housing also operably supported on the latch-supporting flanges for actuating the latching member and for protectingly covering the latching member.

14. A table as defined in claim 13 wherein said fourth axis is misaligned with the first and second axes when said folding leg is in said folded position so that said second link does not tend to lock up and prevent said folding leg from being moved out of said folded position.

15. A folding leg subassembly for portable tables including a tabletop, comprising:

a base plate configured for securement to said tabletop, said base plate including first and second side flanges defining first and second axes of rotation, respectively, and further including a latch-supporting flange;

a folding leg movable between an extended position and a folded position, said folding leg including holes defining third and fourth axes of rotation;

a four bar linkage arrangement including first links pivotally connecting said folding leg to said base plate at said first and third axes and a second link including side members pivotally connecting said folding leg to said base plate at said second and fourth axes, said second link further including a transverse section extending between said side members; and a single latch operably mounted to said latch-supporting flange of said base plate for releasably engaging said transverse section when said folding leg is in said extended position, said latch including a spring-biased latching member slidably supported on said latch-supporting flange and a concavely-shaped housing also operably supported on the latch-supporting flange for actuating the latching member and for protectingly covering the latching member.

16. A folding leg subassembly as defined in claim 15 wherein the concavely-shaped housing includes a transverse flange positioned adjacent the latch-supporting flange.

17. A folding leg subassembly as defined in claim 16 wherein said transverse flange and said latch-supporting flange each include a hole for slidably supporting said latching member.

* * * * *

UNITED STATES PATENT AND TRADEMARK OFFICE

CERTIFICATE OF CORRECTION

PATENT NO. : 5,562,051
DATED : October 8, 1996
INVENTOR(S) : John J. Rizzi

It is certified that error appears in the above-identified patent and that said Letters Patent is hereby corrected as shown below:

Column 4, Line 24;

After "latching member 104.", insert

Figure 15:
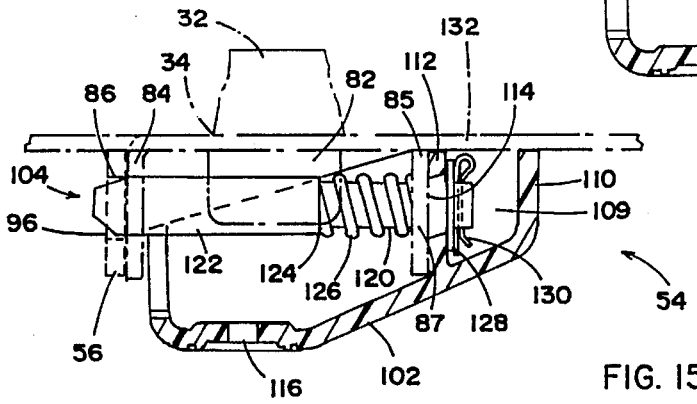
FIG. 15 is an enlarged side cross-sectional view of the releasable latch taken along the plane XV—XV in FIG. 5, the base plate and tabletop being shown in phantom.

–As shown in Fig. 15, latching member 104 can be moved to a release position by moving housing 102 so that latching member 104 moves out of engagement with transverse section 56.–

Signed and Sealed this

Twenty-fifth Day of February, 1997

*Attest:*

*Attesting Officer*

BRUCE LEHMAN

*Commissioner of Patents and Trademarks*